US005688188A

United States Patent [19]

Chappell

[11] Patent Number: 5,688,188

[45] Date of Patent: Nov. 18, 1997

[54] GOLF CLUB

[75] Inventor: Chris Chappell, Westminster, S.C.

[73] Assignee: Dunlop Maxfli Sports, Corp., Greenville, S.C.

[21] Appl. No.: 704,969

[22] Filed: Aug. 29, 1996

[51] Int. Cl.[6] ..... A63B 53/02

[52] U.S. Cl. ..... 473/309

[58] Field of Search ..... 473/309, 310, 473/305, 319

[56] References Cited

U.S. PATENT DOCUMENTS

| | | | |
|---|---|---|---|
| 1,444,842 | 2/1923 | Lagerblade | 473/309 |
| 1,882,509 | 10/1932 | Lagerblade | 473/309 |
| 2,060,872 | 11/1936 | Kraeuter | 473/309 |
| 4,317,986 | 3/1982 | Sullivan . | |
| 5,083,780 | 1/1992 | Walton | 473/320 |
| 5,181,720 | 1/1993 | Stites | 473/312 |
| 5,452,890 | 9/1995 | Bingman | 473/310 |

FOREIGN PATENT DOCUMENTS

| | | | |
|---|---|---|---|
| 384390 | 12/1932 | United Kingdom | 273/80.2 |
| 436625 | 10/1935 | United Kingdom | 273/80.4 |

*Primary Examiner*—Sebastiano Passaniti
*Assistant Examiner*—Stephen L. Blau
*Attorney, Agent, or Firm*—Henry S. Jaudon

[57] ABSTRACT

A golf club having a metal head provided with a hosel having an axial bore having a major diameter which includes a chamfered upper portion and a minor diameter which includes the remaining portion thereof. A shaft having an end diameter substantially conforming with the minor diameter, is located in the bore of the hosel. A ferrule made of a thermoplastic material having a modulus of elasticity of between 5–12 $10^2$ MPa, is formed with an axial bore. A tapered sleeve extends from a lower portion of the ferrule. The ferrule is located in a press fit about the shaft end with the sleeve mattingly received within the major diameter of the hosel providing an extended cushion and reinforcement at the juncture between the shaft and the hosel.

12 Claims, 2 Drawing Sheets

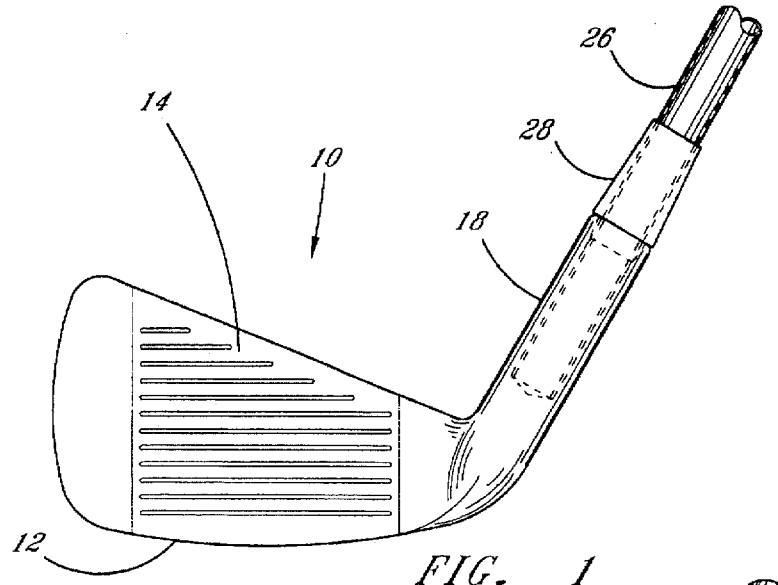
FIG. 1
FIG. 3
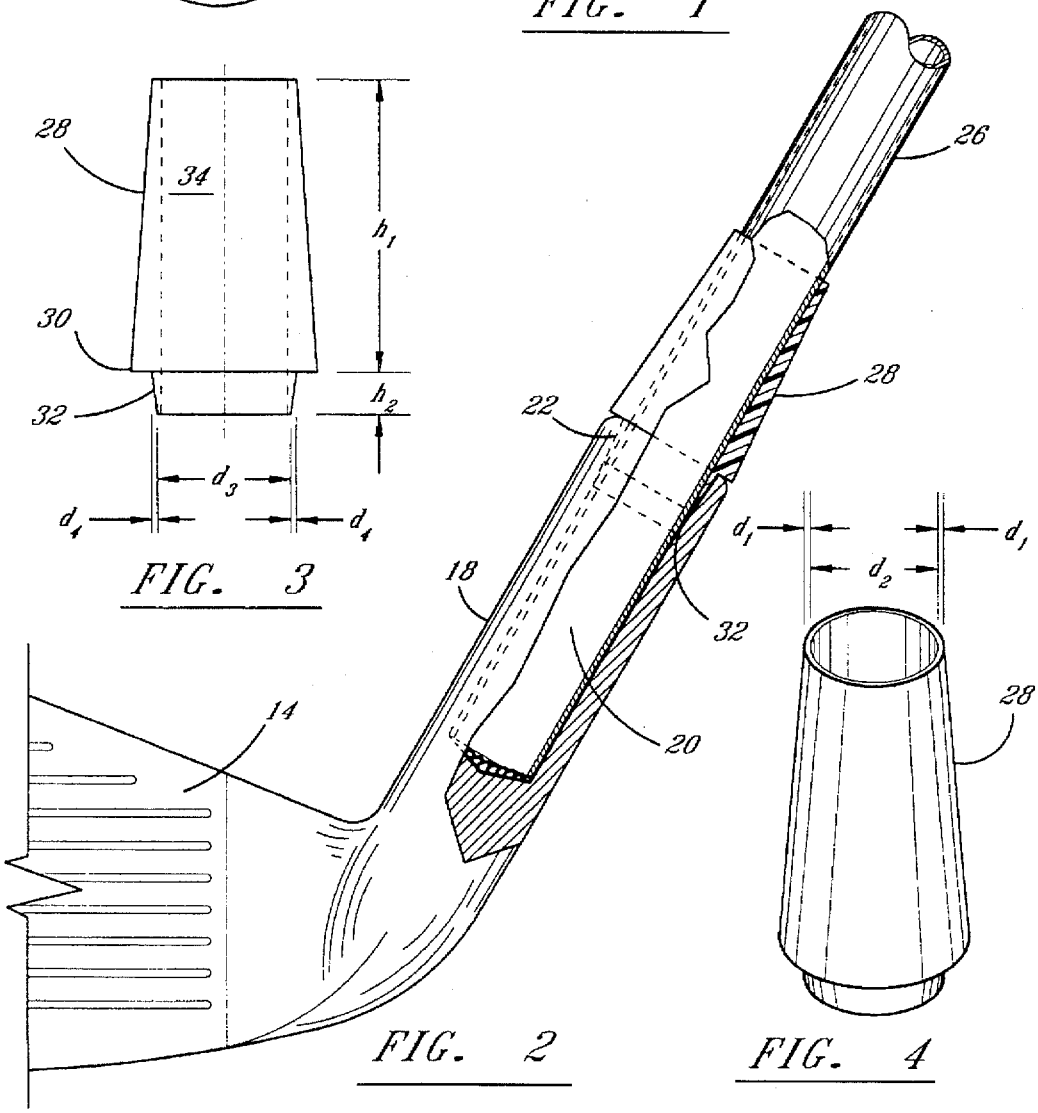
FIG. 2
FIG. 4

GOLF CLUB

BACKGROUND OF THE INVENTION

This invention relates to a tapered ferrule golf club design and more particularly to the golf clubs having graphite or metal shafts having an end portion firmly engaged within the hosel of the club head. A ferrule is provided to be fixed with the shaft and to extend into the bore of the hosel to provide a cushioned engagement area between the shaft and the end of the hosel and to provide reinforcement for the shaft.

Conventional golf clubs are designed so that the tip or end of the shaft enters into a bore in the hosel of the club head and is engaged therein with an epoxy cement. The upper end or opening of the bore is usually formed with a sharp bevel of about 3 mm length. This area is provided simply to facilitate entry of the shaft end into bore of the hosel. A sharp edge or shoulder remains at the lower end of the bevel and in engagement with the shaft. A ferrule is positioned about the shaft and positioned with its lower edge against the hosel end. In practice, a small amount of the epoxy used for securing the shaft with the hosel is forced upward of the hosel bore during entry of the shaft and fills the slight cavity formed by the bevel. The shoulder of the ferrule is retained in position by this epoxy.

The ferrule of the above described arrangement does not provide additional support for the shaft nor does it provide a cushioning effect between the shaft and the shoulder of the bore when the club head is contacted.

The described arrangement experiences a certain amount of shaft breakage which has occurred in the area of the shoulder or contact area with the hosel bore. This breakage is particularly prevalent with graphite and thin lightweight metal shafts.

Accordingly it is an object of this invention to provide a golf club with an improved connection between the hosel and the shaft.

Another object of the invention is to prevent or at least substantially reduce shaft breakage at the connection with the hosel.

Another object of the invention is to provide a golf club in which all components retain their integrity throughout the life of the club.

Another object of the invention is to provide a connection between the hosel and the shaft which cushions impact against the shaft.

Another object of the invention is to provide a connection between the hosel and the shaft which lessens the tendency of the shaft to shear.

Another object of the invention is to provide a ferrule construction which strengthens the shaft in the area of its connection with the hosel.

SUMMARY OF THE INVENTION

The instant invention is directed to the connection between the golf club head and the shaft. The club head includes a face, a sole and a hosel, the hosel having an axial bore which receives an end potion of the shaft. The hosel bore is formed with a major diameter comprising a chamfer and a minor diameter comprising the remaining portion thereof. The shaft has an end diameter which substantially conforms with the minor diameter of the bore of the hosel; and is received therein.

A ferrule is formed of a thermoplastic having a modulus of elasticity of between 5–12 $10^2$ MPa, and an Izod impact strength of 3.0–10.0 ft. lb. The ferrule includes an upper body terminating in a shoulder with a tapered sleeve extending away from its lower side. The ferrule, which has a bore is received in a press fit about the end of the shaft in position for the sleeve to be mattingly received within the major diameter of the hosel bore and with the shoulder in engagement with the top of the hosel. The ferrule acts to provide an extended cushion area and a reinforcement between the shaft and the hosel.

It is preferred that the thermoplastic forming the ferrule be Butyrate although other materials having the proper physical capabilities could be used. The tapered sleeve of the ferrule extends up to approximately 3 mm below the shoulder substantially filling the chamfer of the major diameter area of the hosel. The upper body of the ferrule is tapered from top to bottom so that its wall thickness increases from top to bottom by about 5 mm so that its outer diameter at the shoulder forming its lower end substantially conforms with that of the hosel. The ferrule is formed to have a Rockwell Hardness of at least 12 and an elasticity of more than 70 PSI.

The golf club may have an "iron" head or a "wood" head.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a front sectional view of an iron head golf club and shaft connection;

FIG. 2 is an enlarged sectional view of FIG. 1 showing the connection between the shaft and the hosel of the club head;

FIG. 3 is a front elevation view of the ferrule of the invention.

FIG. 4 is a perspective view of the ferrule;

DESCRIPTION OF A PREFERRED EMBODIMENT

Referring now in more detail to the drawings, the invention will now be described in more detail.

Figure 6:
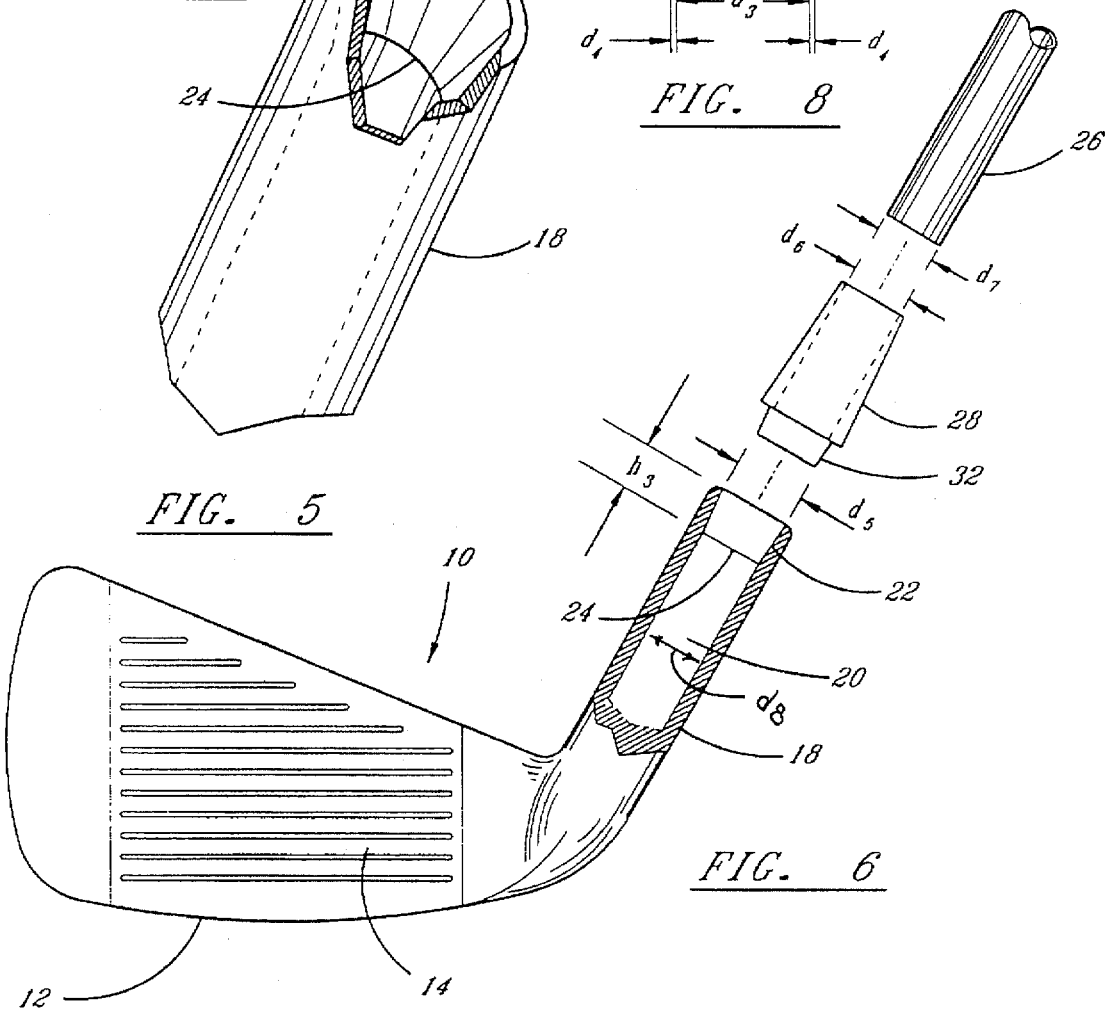
FIG. 6 is an exploded frontal view of the invention.

FIG. 1 shows an illustrative example of a golf club iron in which the connection of the shaft with the hosel has been reinforced with the ferrule. As better seen in FIGS. 2 and 6, iron head 10 of the golf club consists of a sole 12, a face 14 and a hosel 18. The hosel is connected with one edge of face 14 and extends upwardly away from sole 12 in usual manner. The upper end of hosel 18 is formed with an axial bore 20 which extends approximately 32 mm into the hosel.

Bore 20 is formed with a major diameter and a minor diameter with the minor diameter extending along a major portion of the bore is formed to be between 9.1 and 9.5 mm in diameter. The major diameter is formed adjacent the upper end of hosel 20 and comprises an extended chamfer 22. Chamfer 22 begins at the inception of bore 20 where the major diameter is formed to be between approximately 9.4 and 11 mm. The major diameter extends in the axial direction of bore 20 for a distance of 6 or 7 mm where the chamfer gradually and smoothly merges with the minor diameter at 24. Because of the length and gradual slope of chamfer 22 no sharp edge or shoulder is formed at the point of merger. The length of the major diameter and chamber is illustrated at $h_3$ in FIG. 6 while the maximum diameter of the area of major diameter is illustrated at $d_5$. The minor diameter is illustrated at $d_8$.

A golf club shaft, which is formed in a usual manner, is illustrated at 26. Shaft 26 may taper from top to bottom with the bottom end being the smaller section or the shaft may be a parallel tip shaft. In either case, the end of shaft 26 shown connecting with hosel 18 has an outer diameter $d_7$ of between 9.0 and 9.4 mm. Tapered shafts at a point 2. 125" or 54.0 mm from the tip have a diameter of approximately 9.55 mm which diminishes to approximately 9.3 mm at the tip. Of course, parallel tip shafts have a constant diameter along the shaft length which is approximately 9.4 mm.

Figure 7:
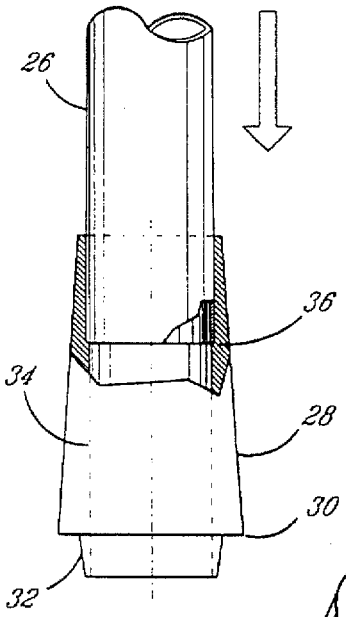
FIG. 7 is a cutaway front view of the shaft end entering the bore of the ferrule.
Figure 8:
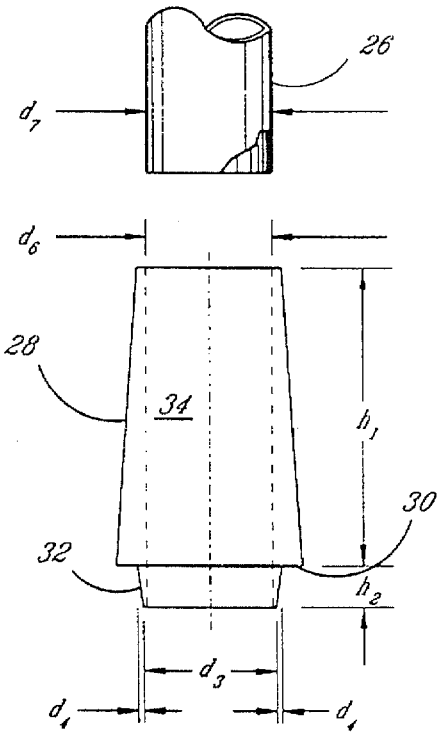
FIG. 8 is an exploded front view of the hosel and shaft end.
Figure 5:
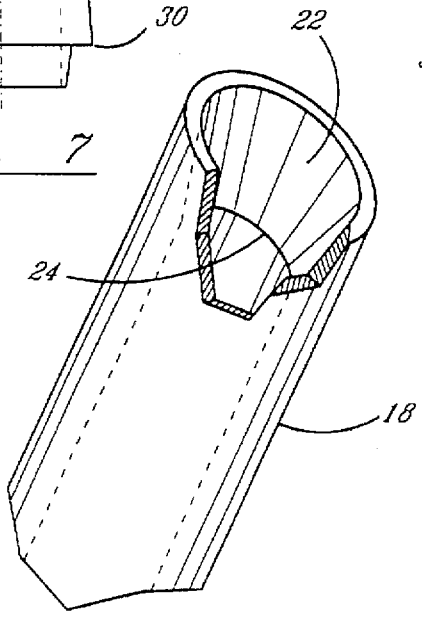
FIG. 5 is a sectional perspective view of the upper end of the hosel.

The ferrule of the invention is shown at 28. Ferrule 28 is constructed to be approximately 25 mm in length with a tapered upper body portion of between 21.7 and 21.8 mm terminating with a shoulder 30. The wall thickness of the upper body portion increases from top to bottom by at least 3 mm and up to 5 mm at the shoulder. This allows the outer diameter of ferrule 28 at shoulder 30 to be substantially equal to the outer diameter of hosel 18. A tapered sleeve 32 extends from the lower face of shoulder 30 for a distance of between 3.1 and 3.2 mm as illustrated at $h_2$ in FIGS. 3 and 8. A bore 34, formed to have a diameter $d_6$ of between 9.2 and 9.3 mm extends axially through ferrule 28.

Ferrule 28 is constructed of a thermoplastic material, preferably Butyrate. The ferrule forming thermoplastic must have a specific gravity within the range of 1.15 to 1.22, a modulus of elasticity of between 70–180 PSI, a shore hardness of at least 60 and an Izod impact strength of 3.0 to 10.0 ft/lbs. in order for the ferrule to function satisfactorily and provide sufficient elastic cushion and sufficient reinforcement to increase the resistance to shaft breakage at its connection with the hosel.

Viewing now FIGS. 1, 2, 7 and 8, shaft 26 is inserted into the upper end of bore 34 of hosel 28. Because the edges of shaft 26 are slightly turned inwardly this operation may be performed without snagging. As the shaft enters bore 34 the larger diameter of shaft 26 forces bore 34 of ferrule 28 to expand which is illustrated at 36. Shaft 26 is forced through bore 34 until the upper edge of ferrule 28 is located approximately 54.0 mm or 2. 125" from the tip of the shaft. At this point the larger diameter of the shaft has forced the ferrule to expand sufficiently for the ferrule to now be engaged with the shaft 26 in a press fit which permanently or fixedly locates the ferrule in that position on the shaft.

After ferrule 28 is fixed in its proper position on the shaft, the end of shaft 26 is coated with an epoxy cement and inserted into bore 20 of hosel 18 to be positioned as shown in FIG. 2.

With shaft 26 positioned in bore 20, sleeve 32 snugly fits within chamfer 22 with its lower end positioned adjacent area 24 and shoulder 30 positioned in engagement with the upper portion of hosel 18.

Sleeve 32 provides an extended contact area between shaft 26 at its point of connection with hosel 18. Due to the elasticity of the thermoplastic material there is a certain amount of cushion or give between the shaft and hosel at this the point of greatest stress. Because ferrule 28 is connected in fixed manner with shaft 26 in a press fit, its position relative to chamfer 22 is permanent and the area of support remains constant. The impact strength of the thermoplastic material allows the ferrule to retain its physical dimensions.

While a preferred embodiment of the invention has been described using specific terms, such description is for illustrative purposes only, and it is to be understood that changes and variations may be made without departing from the spirit or scope of the following claims.

What is claimed is:

1. A golf club comprising a metal head provided with a hosel having an upper end and an axial bore, said bore having a major diameter comprising a chamfered upper portion and a minor diameter remaining portion, said minor diameter portion being at least three times the length of said major diameter portion;

a shaft having an end diameter substantially conforming with said minor diameter received in said bore of said hosel along substantially the entire length of said major and minor diameter portions;

a ferrule having an axial bore, a tapered upper body terminating with a shoulder and a tapered sleeve extending downwardly away from said shoulder with said upper body being at least five times the length of said tapered sleeve, said ferrule being received about said shaft adjacent said end and secured in position with a press fit with said sleeve being mated with said chamfered major portion of said bore and said shoulder being in engagement with said upper end of said hosel, said ferrule being formed of a thermoplastic material having a modulus of elasticity of between 70 and 180 PSI; whereby, said sleeve and said shoulder of said ferrule along with said chamfered major portion provide an extended cushion and reinforcement area providing a smooth merge between said shaft and said hosel adjacent the upper end of said hosel.

2. The golf club of claim 1 wherein said thermoplastic is Butyrate.

3. The golf club of claim 1 wherein said thermoplastic has an impact strength of between 3.0–10.0 ft. lb.

4. The golf club of claim 1 wherein said tapered sleeve extends at least 3 mm below said shoulder.

5. The golf club of claim 1 wherein said upper body of said ferrule is tapered from top to bottom providing an increase of wall thickness from top to bottom of at least 1 mm.

6. The golf club of claim 1 wherein said ferrule has a specific gravity of at least 1.15.

7. The golf club of claim 6 wherein said shaft is retained within said hosel bore with an epoxy cement.

8. A metal golf club head having a hosel receiving an end of a shaft in an elastic reinforced connection; said hosel having an upper end through which a bore extends downwardly into said hosel, said bore includes a larger diameter chamfer which extends from said top downward into said bore for at least 6 mm and a minor diameter remaining portion, said minor diameter portion being at least three times the length of the larger diameter chamfer;

a ferrule formed of thermoplastic material having a Rockwell hardness less than that of said shaft and an impact hardness of between 3.0–10.0 ft lb, said ferrule having a tapered upper body terminating in a shoulder at a lower portion thereof and a tapered sleeve formed beneath and extending away from said shoulder with the upper body being at least five times the length of the tapered sleeve;

said end of said shaft being positioned to extend through said bore of said ferrule and into said hosel bore to be seated in the lower extremity thereof, said ferrule being positioned on said shaft with said sleeve fitting into and extending along the length of said chamfer and said shoulder in engagement with said upper end of said hosel said ferrule being permantely retained in said position with a press fit; whereby, said ferrule and said chamfer act to cushion impact force against said shaft where it joins said bore of said hosel by providing an extended engagement area along the length of said shaft and by eliminating the presence of a sharp shoulder engaging said shaft.

9. The golf club of claim 8 wherein said shaft is one of light weight metal and graphite.

10. The golf club of claim 8 wherein said thermoplastic forming said ferrule has a Rockwell hardness of at least 12 and an elasticity of between 70–180 PSI.

11. The golf club of claim 8 wherein said bore through said ferrule has a diameter of approximately 0.3 mm less than the diameter of said shaft before being press fitted.

12. The golf club of claim 8 wherein said golf club head is an iron head.

* * * * *

UNITED STATES PATENT AND TRADEMARK OFFICE

CERTIFICATE OF CORRECTION

PATENT NO. : 5,688,188
DATED : November 18, 1997
INVENTOR(S) : Chris Chappell

It is certified that error appears in the above-identified patent and that said Letters Patent is hereby corrected as shown below:

Column 2,
Line 20, after "than" please delete "70" and insert -- 70,000 --.

Column 3,
Line 35, after "between" please delete "70-180 PSI" and insert -- 70,000-180,000 PSI, --.

Column 4,
Line 30, after "between" please delete "70-180 PSI" and insert -- 70,000-180,000 PSI, --.

Column 6,
Line 5, after "between" please delete "70-180 PSI" and insert -- 70,000-180,000 PSI, --.

Signed and Sealed this

Eleventh Day of February, 2003

JAMES E. ROGAN
*Director of the United States Patent and Trademark Office*